US007200892B2

(12) United States Patent
Kim

(10) Patent No.: US 7,200,892 B2
(45) Date of Patent: Apr. 10, 2007

(54) ROBOT CLEANER WITH ADJUSTABLE BRUSH

(75) Inventor: Ki-man Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 590 days.

(21) Appl. No.: 10/689,070

(22) Filed: Oct. 21, 2003

(65) Prior Publication Data

US 2005/0015912 A1 Jan. 27, 2005

(30) Foreign Application Priority Data

Jul. 24, 2003 (KR) ..... 10-2003-0051126

(51) Int. Cl.
*A47L 9/04* (2006.01)

(52) U.S. Cl. ..... 15/319; 15/340.3; 15/371; 15/372

(58) Field of Classification Search ..... 15/319, 15/340.3, 368, 371, 372, 422
See application file for complete search history.

(56) References Cited

U.S. PATENT DOCUMENTS

| | | | | |
|---|---|---|---|---|
| 1,904,972 | A * | 4/1933 | Willis | 15/357 |
| 2,416,420 | A * | 2/1947 | Taylor | 15/372 |
| 2,668,979 | A * | 2/1954 | MacFarland | 15/368 |
| 4,355,436 | A * | 10/1982 | Hertzberg | 15/368 |
| 4,706,327 | A | 11/1987 | Getz et al. | 15/319 |
| 4,976,003 | A | 12/1990 | Williams | 15/372 |
| 5,148,569 | A | 9/1992 | Jailor et al. | 15/41.1 |
| 5,317,784 | A | 6/1994 | Glenn, III et al. | 15/356 |
| 5,477,587 | A | 12/1995 | Glenn, III et al. | 15/356 |
| 5,781,960 | A | 7/1998 | Kilstrom et al. | 15/319 |
| 6,381,802 | B2 | 5/2002 | Park | 15/325 |
| 6,519,804 | B1 | 2/2003 | Vujik | 15/331 |
| 6,581,239 | B1 * | 6/2003 | Dyson et al. | 15/340.3 |
| 6,983,511 | B2 * | 1/2006 | Massaro | 15/422 |
| 2004/0049877 | A1 | 3/2004 | Jones et al. | 15/319 |

FOREIGN PATENT DOCUMENTS

| | | |
|---|---|---|
| DE | 43 44 596 C2 | 12/1995 |
| EP | 0 803 224 B1 | 12/2002 |

(Continued)

OTHER PUBLICATIONS

Search Report issued Mar. 5, 2004 from the Dutch Industrial Property Office with respect to Dutch Patent Application No. 1024656 filed on Oct. 29, 2003.

(Continued)

*Primary Examiner*—Theresa T. Snider
(74) *Attorney, Agent, or Firm*—Blank Rome LLP

(57) ABSTRACT

A robot cleaner with a pivotable brush which pivots in accordance with a condition of a floor surface to be cleaned. The pivotal brush prevents overload to a suction motor caused by excessive contact of the brush with the floor surface to be cleaned. The robot cleaner includes a robot cleaner body with a hinge receiving portion, a brush frame with a hinge protrusion pivotally connected to the hinge receiving portion, and a suction port sealingly connected with the dust suction portion of the robot cleaner body. A brush cover is detachable from the brush frame via a brush cover locking mechanism. A rotatable brush is rotatably disposed between the brush frame and the brush cover.

9 Claims, 5 Drawing Sheets

FOREIGN PATENT DOCUMENTS

| | | |
|---|---|---|
| JP | 2002-532180 | 10/2002 |
| WO | WO 92/10967 | 7/1992 |
| WO | WO-A 01/41617 | 6/2001 |

OTHER PUBLICATIONS

Combined Search and Examination Report issued May 6, 2004 from the British Patent Office with respect to British Application No. 0326252.4 filed on Nov. 11, 2003.

Australian Patent Office Action issued on Feb. 4, 2005 in corresponding Australian Patent Application No. 2003259634.

Russian Patent Office issued in connection with corresponding Application No. 2003134223.

Japanese Patent Office, Office Action issued Jun. 20, 2006 with respect to Japanese Patent Application No. 2004-33755 filed on Feb. 10, 2004.

* cited by examiner

ROBOT CLEANER WITH ADJUSTABLE BRUSH

FIELD OF THE INVENTION

The present invention relates to a robot cleaner, and more particularly, to a robot cleaner having an adjustable brush which is automatically adjusted in height in accordance with the condition of a surface to be cleaned to maintain a predetermined constant distance between the brush and the surface to be cleaned.

BACKGROUND

As generally known, a robot cleaner automatically runs along the floor surface of a room and cleans the area by drawing in dust and dirt from the floor surface.

FIGS. 1 and 2 show one example of such a robot cleaner, which will be briefly described below.

FIG. 1 is a perspective view illustrating a conventional robot cleaner from which a cover is separated, and FIG. 2 is a bottom view illustrating FIG. 1 from a bottom side. The reference numeral 10 denotes a robot cleaner body, 20 is a dust suction portion, 30 is a suction opening, 40 is a sensor portion, 50 is a control portion and 60 is a battery.

As shown, there are a plurality of driving wheels 11, 12 disposed at both sides of the robot cleaner body 10 for the running of the robot cleaner. The robot cleaner body 10 is substantially a circular plate, with a substantially hemispherical cover attached thereto. The cover is omitted in the drawing.

The dust suction portion 20 functions to draw in dust from the floor surface with a strong suction force that the dust suction portion 20 generates at a suction port (not shown) formed in the robot cleaner body 10. The dust suction portion 20 includes a vacuum motor (not shown), and a dust collecting chamber (not shown) for collecting dust which is drawn in through the suction port by the driving of the vacuum motor.

The suction opening 30 is formed in the lower surface of the robot cleaner body 10 in fluid communication with the suction port, and within the suction opening 30, there is a rotatable brush 31 for dusting off the floor surface to be cleaned.

The sensor portion 40 is disposed along a side of the robot cleaner body 10 at predetermined intervals to externally transmit signals and receive the reflected signals. The sensor portion 40 includes an obstacle sensor (not shown) and a moving distance sensor (not shown).

The control portion 50 processes the signals received at a transceiving portion thereof, and controls the respective components, respectively. More specifically, the control portion 40 receives signals from an external control apparatus or from a remote controller, and accordingly drives the driving wheels 11, 12 and the vacuum motor of the dust suction portion 20. Further, the control portion 50 controls the operation of the robot cleaner according to the signals received from the sensor portion 40.

The robot cleaner as described above, can determine a distance to obstacles such as furniture, office machines, and walls through the sensor portion 40, and selectively drive the driving wheels 11, 12 of the robot cleaner body 10 according to that determination. When necessary, the robot cleaner can also change the direction of motion.

However, the conventional robot cleaner as described above has a problem. That is, because the suction opening 30 is fixed to the robot cleaner body 10, the distance between the floor surface to be cleaned and the suction opening 30 is subject to change in accordance with the characteristics of the floor surface to be cleaned. Accordingly, problems such as excessive contact of the suction opening 30 with the floor surface to be cleaned can occur. For example, if the robot cleaner works on a hairy area such as a carpet on the floor surface, excessive contact between the suction opening 30 with the floor surface to be cleaned may cause overload to the vacuum motor, and as a result, suction efficiency deteriorates and noise generates. Further, because the suction opening 30 is integrally formed with the robot cleaner body 10, the user of the cleaner experiences inconvenience in cleaning the suction opening 30 when contaminated.

SUMMARY OF THE INVENTION

The present invention overcomes the above-mentioned problems of the background art, and accordingly, in an effort to solve the problems as mentioned above, it is an aspect of the present invention to provide a robot cleaner of improved structure, which is capable of maintaining a predetermined constant distance between a brush thereof and a floor surface to be cleaned regardless of the characteristics of the floor surface, and also enables an easier maintenance of the brush.

In an effort to accomplish the above aspect and/or other features of the present invention, there is provided a robot cleaner, which includes a robot cleaner body, a brush frame having a hinge protrusion pivotally connected to the hinge receiving portion, and a suction port sealingly connected with the dust suction portion of the robot cleaner body; and a rotatable brush rotatably disposed between the brush frame and the brush cover. The robot cleaner body has a controlling portion which is programmed to control the robot cleaner to automatically run and clean a floor surface to be cleaned in accordance with predetermined set values, a driving portion driven in accordance with a control signal from the controlling portion, a dust suction portion for capturing and collecting dust by a suction motor, and a hinge receiving portion protruding to oppose the floor surface to be cleaned. The brush frame is ascended and descended in accordance with the condition of the floor surface to be cleaned.

The hinge receiving portion is protruded from a brush frame seating portion which is provided to the robot cleaner body.

The brush frame has a hinge receiving portion insertion hole corresponding in position to the hinge receiving portion to allow the hinge receiving portion to pass therethrough, and a hinge protrusion formed on an inner circumference of the hinge receiving portion insertion hole.

The hinge protrusion includes a boss portion protruding from the inner circumference of the hinge receiving portion insertion hole substantially conforming to a shape of a cylindrical column, and a disc member for preventing the boss portion from separating in an axial direction.

The brush frame is pivoted between a first position and a second position to prevent an excessive contact to the surface to be cleaned. The first position is for a hard floor surface such as a wooden floor and the second position is for a hairy floor surface such as a carpet having plural bristles embedded therein. The brush frame in the first position is pivoted about the hinge protrusion by its own weight to contact the floor surface to be cleaned, and the brush frame in the second position is pivoted about the hinge protrusion by the support of the upper portion of bristles of the floor surface to be cleaned.

The brush frame has a rotatable brush seating groove in which the rotatable brush is rotatably seated, and a suction passage for fluidly communicating the rotatable brush seating groove with the suction port.

The brush cover has a suction hole which is divided by a plurality of rib members.

The rotatable brush has at least one spiral blade formed on an outer circumference thereof. The spiral blade is cut in the locations corresponding to the plurality of rib members.

Meanwhile, the brush cover locking means has at least one locking member rotatably provided to the brush cover through a locker mounting hole defined in the brush cover to rotate clockwise and counterclockwise directions. The locking member includes a locker which has a long axis and a short axis on one end, and a circular manipulation portion on the other end to rotatably move the locker between a locking position and a unlocking position. The brush cover locking means also has at least one locking hole corresponding in position with the locking member of the brush frame, and also corresponding in shape with the locker.

A linear protrusion is formed across a center of the circular manipulation portion, and position marks are formed around a circumference of the locker mounting hole at an angle approximately 90° to indicate locking and unlocking positions of the locker.

BRIEF DESCRIPTION OF THE DRAWINGS

The above aspects and other features of the present invention will become more apparent by describing in detail a preferred embodiment thereof with reference to the attached drawings, in which.

DETAILED DESCRIPTION OF THE PREFERRED EMBODIMENTS

Hereinafter, the present invention will be described in detail with reference to the accompanying drawings.

Figure 1:
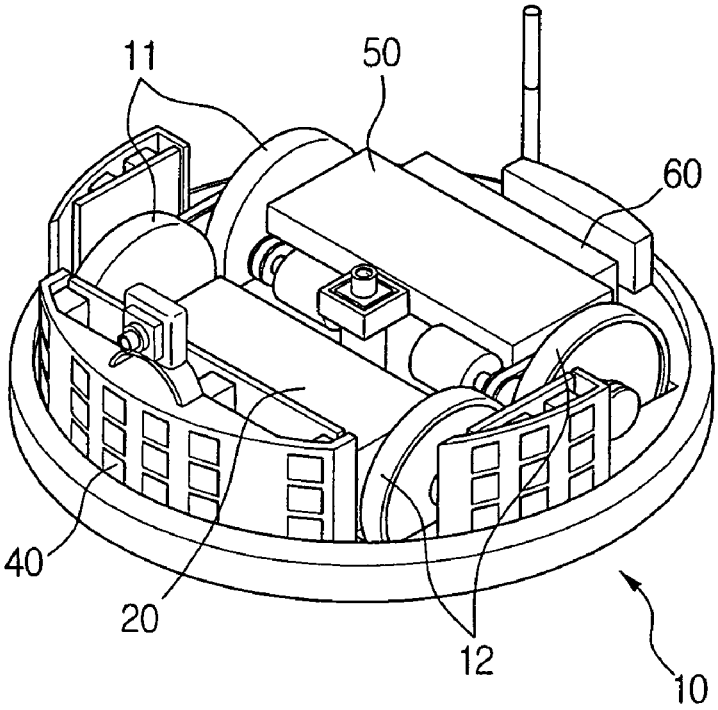
FIG. 1 (PRIOR ART)
FIG. 1 is a perspective view of a conventional robot cleaner.
Figure 2:
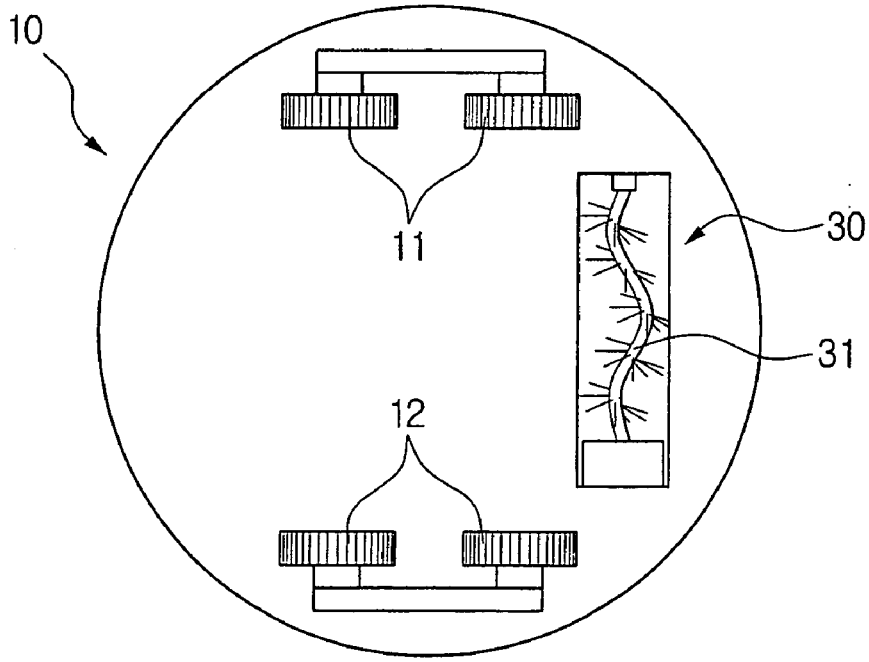
FIG. 2 (PRIOR ART)
FIG. 2 is a bottom view of FIG. 1.
Figure 3:
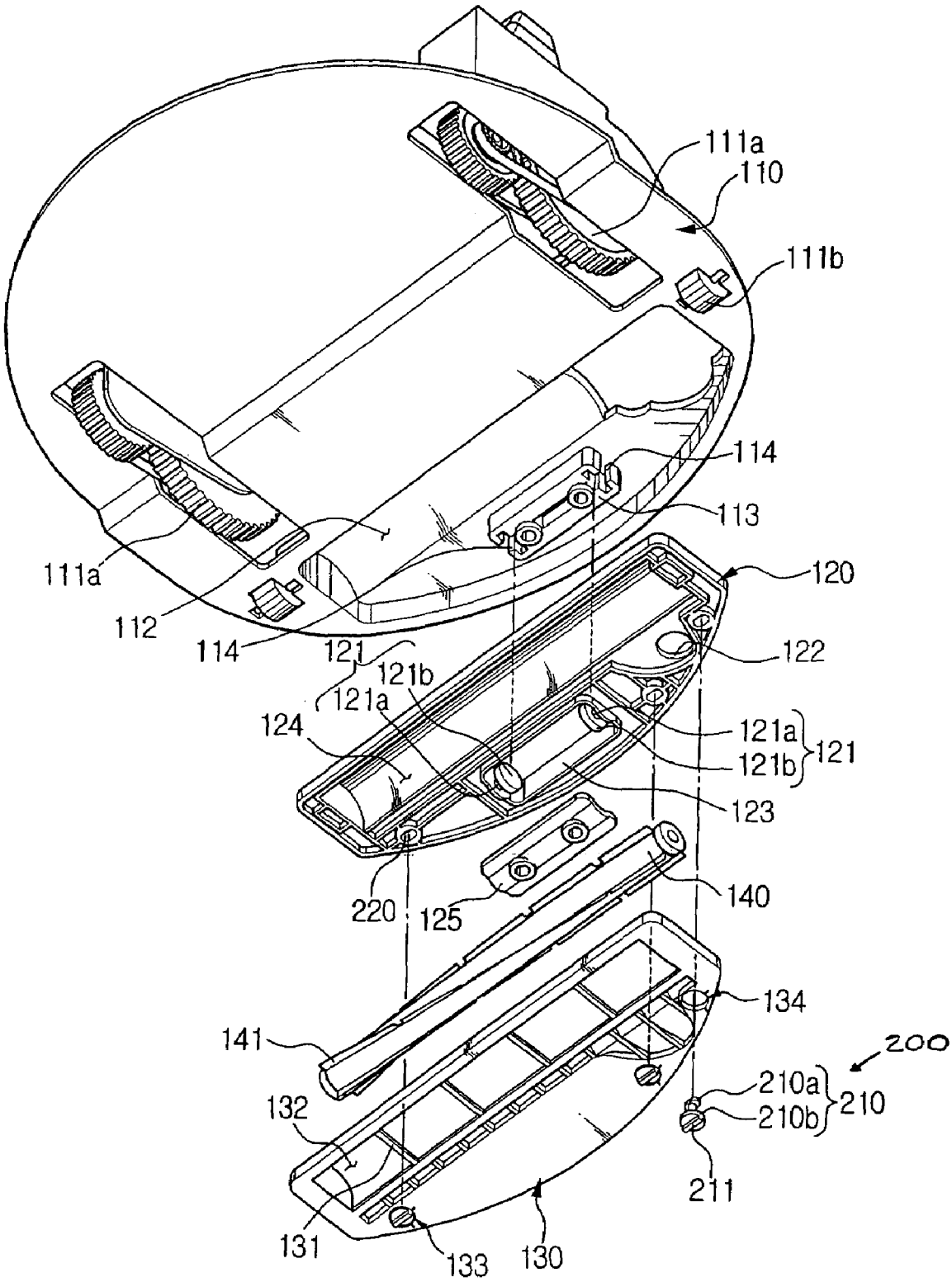
FIG. 3 is an exploded perspective view illustrating a robot cleaner according to the present invention from the bottom side.

FIG. 3 is an exploded perspective view of a robot cleaner according to one preferred embodiment of the present invention. In FIG. 3, a reference numeral 110 denotes a robot cleaner body, 120 is a brush frame, 130 is a brush cover and 140 is a rotatable brush.

The robot cleaner body 110 includes a plurality of driving wheels 111*a* and secondary wheels 111*b* for stopping and driving the robot cleaner 110 by a driving motor (not shown). There are a vacuum motor (not shown) and a dust collecting chamber (not shown) provided within the robot cleaner body 110. The dust collecting chamber is in fluid communication with a suction port 122 formed in the brush frame 120, to collect dust from the surface to be cleaned. In order for the brush frame 120 to be inserted into the robot cleaner body 110, a brush frame seating portion 112 is preferably provided. There are hinge protrusions 121 formed on the brush frame 120, and the brush frame seating portion 112 has a hinge receiving portion 113 formed in the location corresponding to the hinge protrusion 121 of the brush frame 120. The hinge receiving portion 113 is protruded from the bottom of the brush frame seating portion 112 to a polygonal column, and preferably, has a hinge receiving groove 114 corresponding in shape with the hinge protrusion 121. The joining of the hinge protrusion 121 with the hinge receiving groove 114 will be described in greater detail below.

The brush frame 120 includes the hinge protrusion 121 pivotally joined in the hinge receiving portion 113, the suction port 122 sealingly connected with a dust suction portion (not shown) provided to the robot cleaner body 10, a hinge receiving portion insertion hole 123 formed in a location corresponding to the brush frame 120 so as to allow the hinge receiving portion 113 to pass therethrough, and a rotatable brush seating groove 124 in which the rotatable brush 140 is rotatably disposed.

The hinge protrusion 121 includes a boss 121*a* sized to have a diameter corresponding to that of the hinge receiving groove 114, and a disc member 121*b* formed at an end of the boss 121*a* to prevent separation of the hinge protrusion 121. The hinge protrusion 121 is protruded from an inner circumference of the hinge receiving portion insertion hole 123 which will be described below in greater detail. It is preferable that a pair of bosses 121*a* are formed on the inner circumference of the hinge receiving portion insertion hole 123 in parallel with the driving axes of the driving wheels 111*a* of the robot cleaner body 110.

Figure 4:
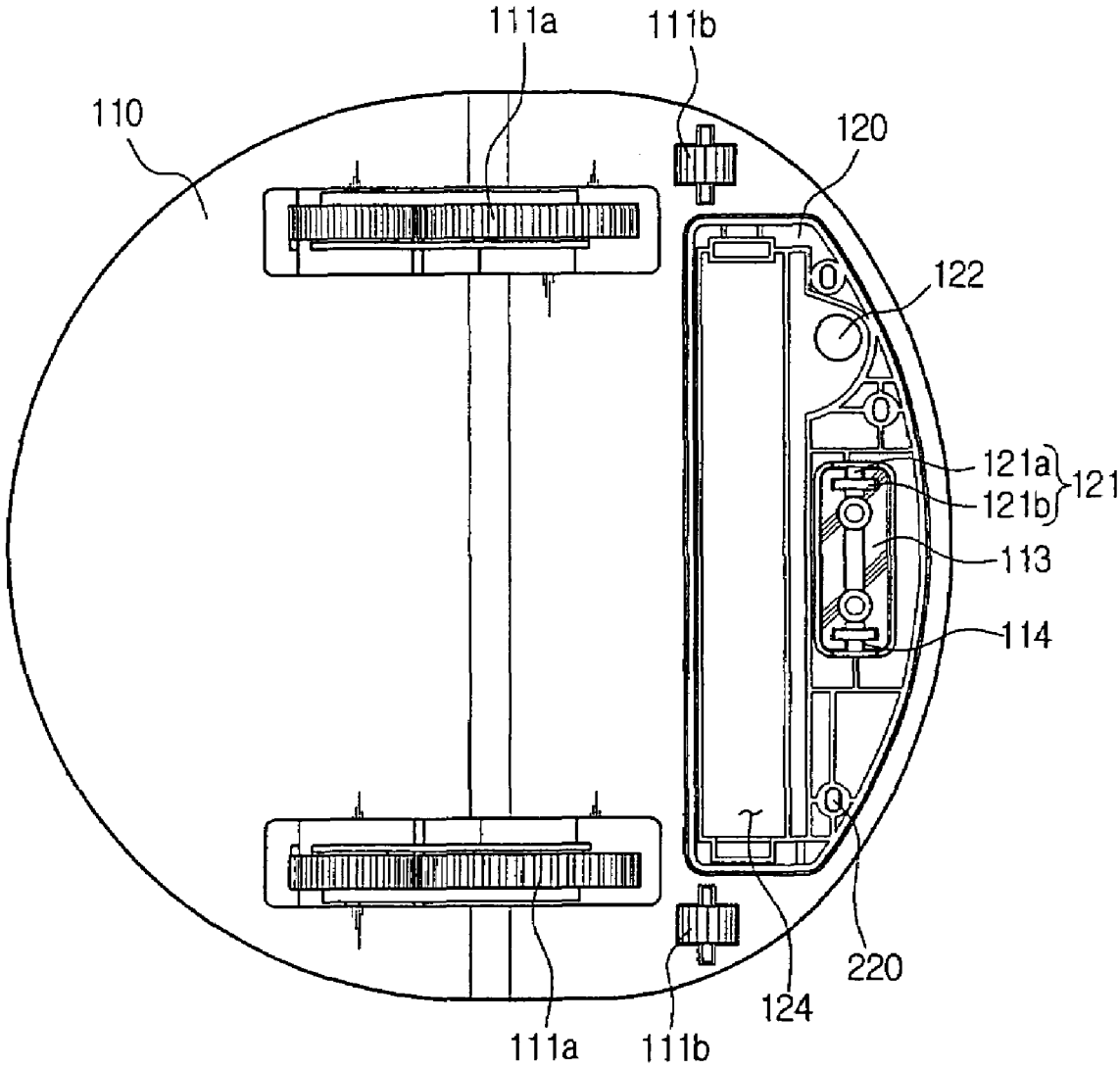
FIG. 4 is a plan view illustrating the bottom side of the robot cleaner according to the present invention.
Figure 5:
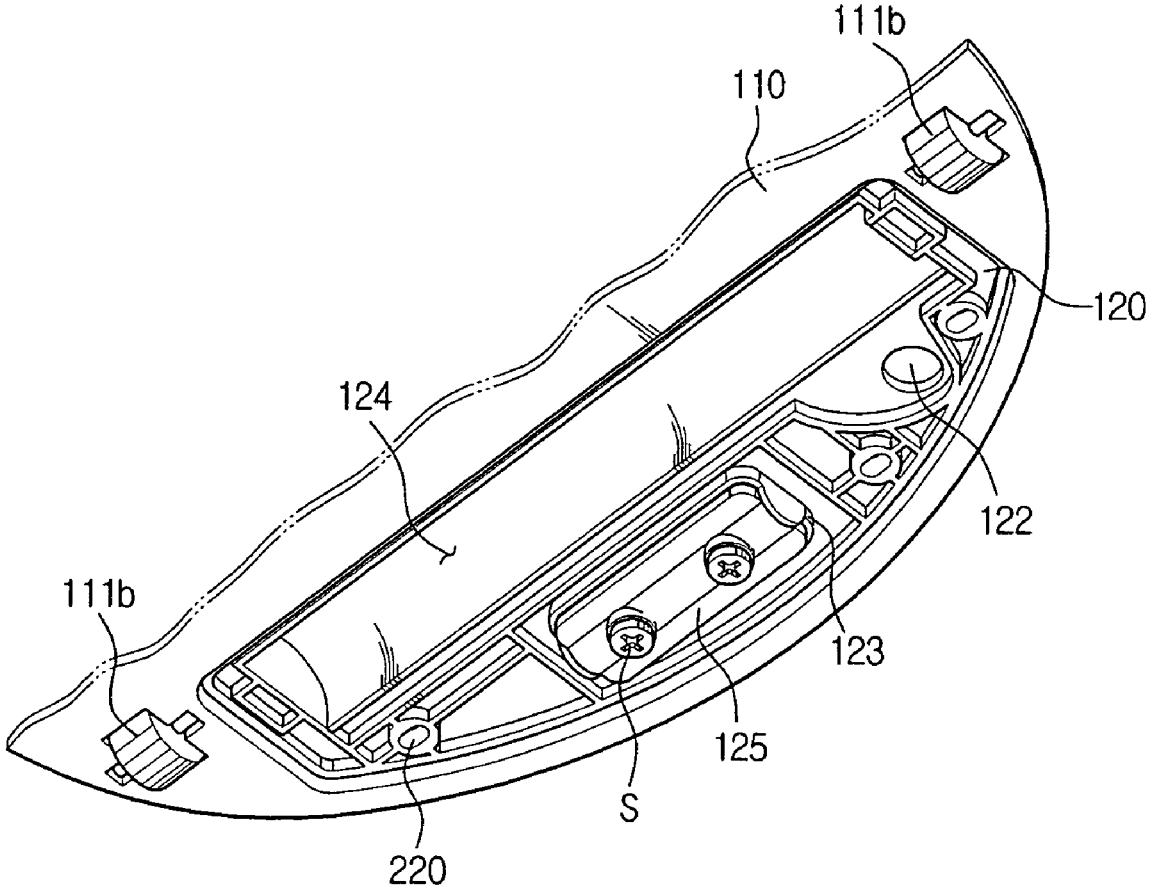
FIG. 5 is a perspective view illustrating a robot cleaner body to which a brush frame, with a brush frame cover and a rotatable brush being removed therefrom, is attached.

Meanwhile, the hinge receiving portion insertion hole 123 is preferably formed in a shape corresponding to the hinge receiving portion 113, and according to the present embodiment, the hinge receiving portion insertion hole 123 is formed in a rectangular shape as the hinge receiving portion 113 (FIGS. 3 and 4). The hinge protrusion 121 is protruded from the inner circumference of the hinge receiving portion insertion hole 123. Meanwhile, as shown in FIG. 5, the hinge protrusion 121 seated in the hinge receiving groove 114 is prevented from separating due to the presence of a connecting member 125 which is secured by the screws (S).

The rotatable brush seating groove 124 is located where the rotatable brush 140 is rotatably disposed. As the rotatable brush 140 rotates, it strikes, thus 'dusts off' the floor surface to be cleaned. In order to have efficient suctioning of the dust separated off from the floor surface, the rotatable brush seating groove 124 is fluidly communicated with the suction port 122 through a suction passage.

Figure 6:
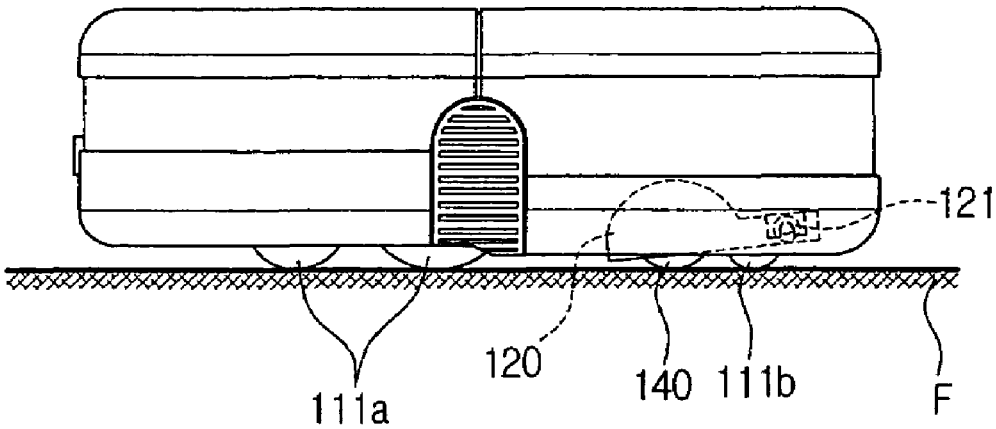
FIG. 6 is a side view showing the position of the brush frame in the case that the robot cleaner according to the present invention cleans a flat floor surface.
Figure 7:
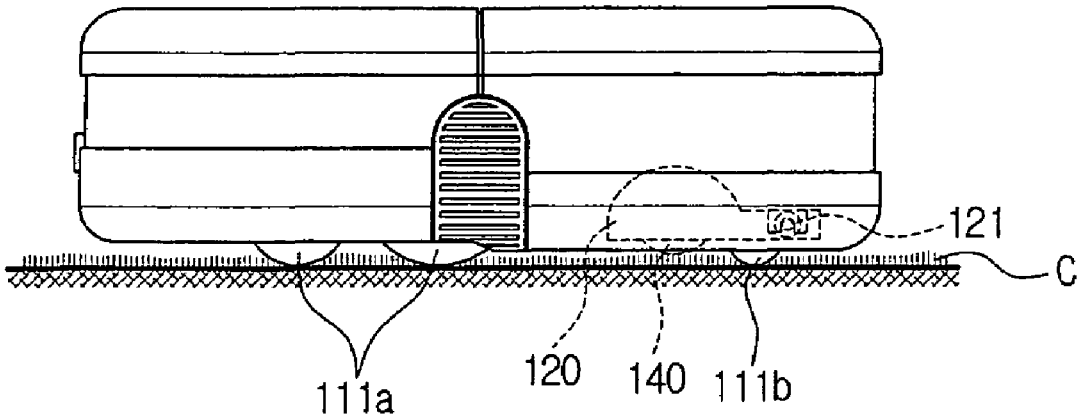
FIG. 7 is a side view illustrating the position of the brush frame in the case that the robot cleaner according to the present invention cleans a hairy floor surface such as a carpet.

The brush frame 120 constructed as above moves from the first position for the cleaning of hard floor surface F such as a wooden floor as shown in FIG. 6 to the second position for the cleaning of hairy floor surface C such as a carpet as shown in FIG. 7. In the first position, the brush frame 120 is tightly contacted with the floor surface F to be cleaned by its own weight, while in the second position, the brush frame 120 is spaced apart from the floor surface C by being supported on the upper side of the hair of the floor surface C and thus prevented from the tight contact.

The brush cover 130 is removably connected to the brush frame 120 by a brush cover locking means 200. The brush cover 130 includes a suction hole 132 which is divided by a plurality of ribs 131.

The rotatable brush 140 includes at least one spiral blade 141 formed thereon, and the blade 141 is made of a rubber or any material similar in characteristic to stably strike the floor surface to be cleaned. As shown, the blade 141 is cut in the locations corresponding to the ribs 131 to remove the dust or dirt piled on the ribs 131.

The brush cover locking means 200 includes at least one locking member 210 and at least one locking hole 220. The locking member 210 is rotatably provided to the brush cover 130 through a locker mounting hole 133 defined in the brush cover 130 to rotate clockwise and counterclockwise directions, and includes a locker 210*a* which has a long axis and a short axis at one end, and a circular manipulation portion 210*b* at the other end to rotatably move the locker 210*a* between a locking position and a unlocking position. The locking hole 220 corresponds in position with the locking member 210 of the brush frame 120, and also corresponds in shape with the locker 210*a*.

As shown in FIG. 3, the circular manipulation portion 210*b* of the locking member 210 has a linear protrusion 211 formed across the center, and the circular manipulation portion 210*b* may further include a position mark 134 formed at 90° to indicate the locking and unlocking positions, respectively.

Hereinbelow, the operation of the robot cleaner will be described in greater detail with reference to the accompanying drawings.

As the user starts driving the robot cleaner, the robot cleaner starts cleaning the given area while continuously determining its location through the signals obtained through the sensor portion.

In normal operation as shown in FIG. 6, the robot cleaner cleans the hard floor surface F such as a wooden floor. In this case, the brush frame 110 of the robot cleaner is pivoted by its own weight around the hinge protrusion 121 to capture the dust and dirt from the floor surface F in the first position which contacts with the floor surface F.

In the operation for the hairy floor surface C such as a carpet, as shown in FIG. 7, the brush frame 110 of the robot cleaner is pivoted upward on the hinge protrusion 121 by contact with the upper portion of the bristles of the carpet. Accordingly, the cleaning operation is performed with the brush frame 110 in the second position, i.e., being supported on the upper portion of the bristles of the carpet.

As described above, because the brush frame 120 is ascended and descended in accordance with the condition of the floor surface to be cleaned, excessively tight contact between the floor surface and the suction opening 131 is prevented, and therefore, there is no degradation of suction efficiency nor the noise during the cleaning operation.

Meanwhile, dust may come in between the rotatable brush 140 and the rotatable brush seating groove 124 of the brush frame 120 as the robot cleaner is used for a long period of time. However, this problem can be avoided according to the present invention, by detaching the brush frame cover 130. That is, the brush frame cover 130 is easily detachable by the brush cover locking means 200 without requiring any opening tool. As described above, there exists the linear protrusion 211 which is formed across the center of the circular manipulation portion 210*b* of the locking member 210, and therefore, the user may simply grab the linear protrusion 211 and rotate the locking member 210 clockwise and counterclockwise to locking and unlocking positions.

With the robot cleaner constructed as above according to the present invention, the brush hinged to the robot cleaner body is pivoted upward and downward in accordance with the condition of the floor surface to be cleaned to thereby maintain a predetermined constant distance between the suction port and the floor surface to be cleaned. As a result, overload of the suction motor due to excessively tight contact between the suction port and the floor cleaning surface can be avoided, and noise from the motor can be prevented.

Further, because the brush frame cover is detachable without requiring any tool, maintenance of the rotatable brush is convenient.

Although the preferred embodiments are described above for purposes of illustration and description, the invention is not to be considered limited by the above description, but is to be considered as including any modifications, changes and alterations and the invention is to be limited only by the following claims.

What is claimed is:

1. A robot cleaner, comprising:

a robot cleaner body comprising, a controlling portion which is programmed to control the robot cleaner to automatically run and clean a floor surface to be cleaned in accordance with predetermined set values;

a driving portion driven in accordance with a control signal from the controlling portion;

a dust suction portion for capturing and collecting dust by a suction motor; and a hinge receiving portion protruding to oppose the floor surface to be cleaned, and the hinge receiving portion protrudes from a brush frame seating portion which is provided to the robot cleaner body;

a brush frame comprising a hinge protrusion pivotally connected to the hinge receiving portion, a suction port sealingly connected with the dust suction portion of the robot cleaner body, a hinge receiving portion insertion hole corresponding in position to the hinge receiving portion to allow the hinge receiving portion to pass therethrough, and a hinge protrusion formed on an inner circumference of the hinge receiving portion insertion hole; and a rotatable brush rotatably disposed between the brush frame and a brush cover, wherein the brush frame is ascended and descended in accordance with the condition of the floor surface to be cleaned.

2. The robot cleaner of claim 1 wherein the hinge protrusion comprises:

a boss portion protruding from the inner circumference of the hinge receiving portion insertion hole substantially to a shape of a cylindrical column; and a disc member for preventing the boss portion from separating in an axial direction.

3. The robot cleaner of claim 1, wherein the brush frame is pivotable between a first position and a second position and wherein the brush frame in the first position pivots about the hinge protrusion to contact the floor surface to be cleaned, and the brush frame in the second position pivots about the hinge protrusion and is spaced from the floor surface to be cleaned.

4. The robot cleaner of claim 1, wherein the brush frame comprises a rotatable brush seating groove in which the rotatable brush is rotatably seated, and a suction passage for fluidly communicating the rotatable brush seating groove with the suction port.

5. The robot cleaner of claim 1, wherein the brush cover comprises a suction hole which is divided by a plurality of rib members.

6. The robot cleaner of claim 5, wherein the rotatable brush comprises at least one spiral blade formed on an outer circumference thereof.

7. The robot cleaner of claim 5, wherein the spiral blade is cut in the locations corresponding to the plurality of rib members.

8. The robot cleaner of claim 1, wherein the brush cover comprises:

at least one locking member rotatably provided to the brush cover through a locker mounting hole defined in the brush cover to rotate clockwise and counterclockwise directions, and includes a locker which has a long axis and a short axis on one end, and a circular manipulation portion on another end to rotatably move the locker between a locking position and an unlocking position; and at least one locking hole corresponding in position with the locking member of the brush frame, and also corresponding in shape with the locker.

9. The robot cleaner of claim 8, wherein a linear protrusion is formed across a center of the circular manipulation portion, and a position mark is formed on a circumference of the locker mounting hole to indicate locking and unlocking positions of the locker.

* * * * *